US005982083A

United States Patent [19]

Ju et al.

[11] Patent Number: 5,982,083

[45] Date of Patent: Nov. 9, 1999

[54] CATHODE FOR ELECTRON TUBE

[75] Inventors: Gyu-Nam Ju, Seoul; Jong-Seo Choi, Anyang; Keun-Bae Kim, Seoul; Kwang-Min Lee, Suwon; Kwi-Seok Choi, Seoul; Su-Chan Lee; Sang-Jin Lee, both of Suwon, all of Rep. of Korea

[73] Assignee: SAMSUNG Display Devices Co., Ltd., Kyungki-do, Rep. of Korea

[21] Appl. No.: 08/744,453

[22] Filed: Nov. 7, 1996

Related U.S. Application Data

[63] Continuation-in-part of application No. 08/393,534, Feb. 23, 1995, Pat. No. 5,698,937.

[51] Int. Cl.[6] ..... H01J 1/13

[52] U.S. Cl. ..... 313/346 R; 313/337; 313/270

[58] Field of Search ..... 313/346 R, 346 DC, 313/337, 270

[56] References Cited

U.S. PATENT DOCUMENTS

| | | | |
|---|---|---|---|
| 3,436,584 | 4/1969 | Hughes et al. | 313/346 |
| 4,017,808 | 4/1977 | Fein et al. | 313/618 X |
| 4,073,989 | 2/1978 | Wainer | 313/103 CM X |
| 4,797,593 | 1/1989 | Saito et al. | 313/346 R |
| 5,030,879 | 7/1991 | Derks | 313/346 R |
| 5,066,885 | 11/1991 | Morimoto et al. | 313/340 |
| 5,146,131 | 9/1992 | Derks | 313/346 R |
| 5,348,934 | 9/1994 | Shaw | 313/346 R X |

FOREIGN PATENT DOCUMENTS

| | | |
|---|---|---|
| 2060246 | 4/1981 | United Kingdom . |

*Primary Examiner*—Ashok Patel
*Attorney, Agent, or Firm*—Leydig, Voit & Mayer, Ltd.

[57] ABSTRACT

A cathode for an electron tube includes a layer of a electron emitting substance containing alkaline earth metal oxides containing 0.01—20.0 wt % of both a lanthanum compound and a magnesium compound or a lanthanum-magnesium compound disposed on a base metal including nickel as a major component and tungsten as a minor component. The tungsten prevents embrittlement and ensures a continuing supply of fill barium in the electron-emitting substance. The cathode enjoys full interchangeability with the conventional oxide cathode and a 15–30% longer life span.

5 Claims, 1 Drawing Sheet

CATHODE FOR ELECTRON TUBE

This disclosure is a continuation-in-part of U.S. patent application Ser. No. 08/393,534, filed Feb. 23, 1995, now U.S. Pat. No. 5,698,937.

BACKGROUND OF THE INVENTION

The present invention relates to a cathode for an electron tube and, more particularly, to a thermal electron emitting cathode having an enhanced life span for use in an electron tube such as a cathode-ray tube or image pickup tube.

In general, referring to FIG. 1 the cathode comprises a disk-like base metal 2, a cylindrical sleeve 3 which is fitted to the bottom surface of the base metal 2 for support and provided with a heater 4 located inside the sleeve for heating the cathode, and an electron-emitting material layer 1 coating the upper surface of the base metal 2.

Here, the electron-emitting material layer 1 is generally an alkaline earth metal oxide having barium oxide as a major component, preferably, a ternary metal oxide expressed as (Ba,Sr,Ca)O.

Such an electron emitting material layer 1 is formed as follows. First, a solution is prepared by dissolving a mixed powder of barium carbonate, strontium carbonate and calcium carbonate in an organic solvent such as nitrocellulose or the like, and then a carbonate salt coating is formed by spraying or electrolytically depositing the prepared solution on a base metal of a cathode used in an electron tube. Afterwards, the carbonate salt coating layer is heated to 1000° C. by heater 4 in a vacuum during which the carbonate salt is converted to an oxide, e.g. barium carbonate is converted to barium oxide. Such a cathode is called an "oxide cathode" because the carbonate salt is converted to an oxide in the vacuum process by the high temperature.

$$BaCO_3 \rightarrow BaO + CO_2\uparrow \quad (1)$$

During cathode operation, the barium oxide reacts with a reducing agent, Si or Mg, contained in the base metal at the interface where the base metal and the layer of the electron-emitting substance contact, to form free barium as shown in the following formulas.

$$BaO + Mg \rightarrow MgO + Ba\uparrow \quad (2)$$

$$BaO + Si \rightarrow Ba_2SiO_4 + 2Ba\uparrow \quad (3)$$

The the free Ba contributes to electron emission. Furthermore, MgO, $Ba_2SiO_4$ or the like are formed in the interface between the electron-emitting substance and the base metal, and serve as a barrier called an "intermediate layer," to prevent the Mg or Si from diffusing. Accordingly, the intermediate layer inhibits the generation of free Ba. Consequently, the intermediate layer contributes to shortening the life span of the cathode. There is another disadvantage in that the high resistance of the intermediate layer prevents the flow of current for emitting electrons and thus limits current density.

Along with popular trends toward higher definition and larger screens for televisions and other devices using cathode-ray tubes, there has been an increasing need for cathodes with high current densities and longer life spans. However, conventional oxide cathodes are not capable of satisfying this need due to the aforementioned disadvantages with respect to performance and life span.

An impregnated cathode is known for its high current density and long life span, but the manufacturing process therefor is complex and its operating temperature is over 1100° C., that is, about 300° C. or 400° C. higher than that of oxide cathodes. Accordingly, since it is required that the cathode be made of a material with a much higher melting point which is expensive, its practical use is impeded.

Thus, a great deal of research has gone into lengthening the life span of a conventional oxide cathode with a high degree of practicality. For example, U.S. Pat. No. 4,797,593 owned by Mitsubishi discloses a technique for improving the life span of a cathode by dispersing a rare-earth metal oxide such as $Sc_2O_3$ or $Y_2O_3$ into a conventional ternary carbonate. Also, U.S. Pat. No. 5,146,131 discloses including $Eu_2O_3$ in an electron-emitting substance to lengthen cathode life span.

The cathodes containing rare-earth metals have enhanced life spans because the rare-earth metal inhibits an intermediate layer from being formed and free Ba from being evaporated. However, the amount of electron emission of the cathode tends to drop off suddenly after a certain period of operation time because the rare-earth metal accelerates sintering of oxides at the operating temperature of the cathode. Thus, the oxide is charred hardened, which results in a decrease of reaction sites for the reducing agent, reducing the quality of emitted electrons. Moreover, because the cathodes have poor cut off drift characteristics and do not have complete interchangeability with a conventional oxide cathode during the manufacturing process, a cathode activation process for ensuring a steady and abundant emission of thermal electrons is required.

SUMMARY OF THE INVENTION

The object of the present invention is to provide a cathode for an electron tube in which the life span is improved dramatically and which has full interchangeability with the processes for manufacturing the conventional cathode.

The object of the present invention is achieved by forming a cathode for an electron tube which includes a base metal containing nickel (Ni) as a major component and tungsten as a minor component, and a layer of an electron-emitting substance disposed on the base metal the layer, including an alkaline earth metal oxide containing barium (Ba) as a major component, a lanthanum compound, and a magnesium compound.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE INVENTION

The magnesium contained in the layer of electron-emitting substance according to the present invention serves to inhibit the rare earth metal from accelerating cathode sintering. Therefore, by including a rare earth metal and magnesium together in the layer of electron-emitting substance, oxide sintering is inhibited, so that a uniform quantity of electrons is emitted for a long time, thereby improving the life span characteristics of a cathode.

An electron-emitting substance layer according to the present invention contains not only a ternary co-precipitate compound such as (Ba,Sr,Ca)O but also a lanthanum compound and a magnesium compound, preferably a lanthanum-magnesium composite compound. Moreover, the ternary co-precipitate oxide (Ba,Sr,Ca)O can be replaced with a binary co-precipitate oxide (Ba,Sr)O.

It is preferred that the content of the lanthanum and magnesium contained in the layer of electron-emitting substance be 0.01 to 20 wt % based on the total weight of the alkaline earth metal oxide. If the amount is less than 0.01 wt %, the life span-enhancing effect is trivial, and if more than 20.0 wt %, the initial emission characteristic is insufficient. Furthermore, it is desirable that the weight ratio of lanthanum and magnesium be 3:1 to 1:3.

Particularly, it is preferable to use lanthanum-nitrate and magnesium-nitrate for forming the lanthanum and magnesium compounds, respectively, because a nitrate has high solubility in butanol or nitrocellulose, which allows uniform dispersion into the carbonate.

Figure 1:
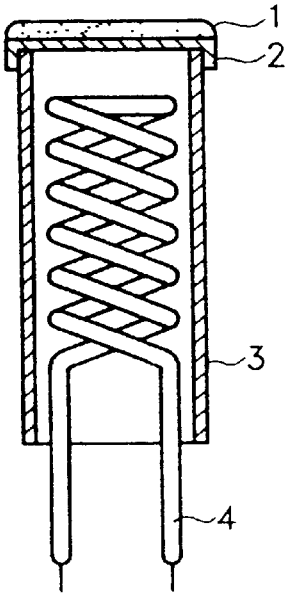
FIG. 1 is a schematic sectional view of a general cathode used for an electron tube.
Figure 2:
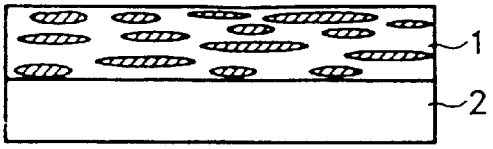
FIG. 2 is an enlarged view illustrating a layer of a typical electron-emitting substance of a conventional cathode for an electron tube, formed of a ternary oxide with a capillary crystalline structure.

Generally, nitrates such as $Ba(NO_3)_2$, $Sr(NO_3)_2$ and $Ca(NO_3)_2$ are dissolved in pure water and then coprecipitated into the solution using $Na_2CO_3$ or $(NH_4)_2CO_3$ as a precipitator to obtain a coprecipitate-ternary carbonate, wherein various forms of carbonate crystal particles are produced, according to the nitrate concentration or pH value, the temperature during precipitation, and the rate of precipitation. During manufacturing of the cathode of the present invention, a carbonate having a capillary crystal structure (known as a preferred structure) can be obtained by controlling these conditions (see FIG. 2).

A lanthanum compound and a magnesium compound can be impregnated in the layer of electron-emitting substance in the same way as the conventional manufacturing process, that is, a lanthanum nitrate and a magnesium nitrate, preferably an La-Mg nitrate, is added to an organic solvent when the coprecipitate-carbonate included in an alkaline earth metal having a capillary crystal structure is manufactured, to ensure that the process of forming the layer of electron-emitting substance has complete interchangeability with the conventional process.

Meanwhile, according to the present invention, the base metal may further contain tungsten which accelerates the generation of free barium according to the following principle.

Tungsten reacts with barium oxide which is generated during the vacuum process for manufacturing an electron tube to form the intermediate product, $Ba_3WO_6$, as shown in the following reaction equations (4) and (5). The generated product reacts with a reducing element, Si, and is reduced to W while generating free barium. Because generated W can again function as a reducing agent, free barium can be generated continuously for a long time.

$$6BaO+W \rightarrow Ba_3WO_6+3Ba\uparrow \quad (4)$$

$$2Si+Ba_3WO_6 \rightarrow Ba_2SiO_4+SiO_2+W+Ba\uparrow \quad (5)$$

As described above, tungsten causes free Ba to be generated for a long time to lengthen the life span of the cathode. For such a purpose, it is desirable that the amount of tungsten added be 0.05~10 wt % based on the weight of the Ni If the amount of tungsten is lower than 0.05 wt %, the generation of free Ba is trivial and if it is more than 10 wt %, the initial amount of free Ba is excessive whereby the life span of the cathode decreases.

Hereinbelow, specific examples according to the present invention will be described more concretely without limiting the scope of the present invention.

EXAMPLE 1

A base metal is prepared using a composite metal composed of Ni, 0.05 wt % of Si and Mg, respectively, with respect to Ni and one side of the prepared base metal is bonded to a sleeve.

Nitrates such as $Ba(NO_3)_2$, $Sr(NO_3)_2$, and $Ca(NO_3)_2$ were dissolved in pure water and coprecipitated using $Na_2CO_3$ to obtain a coprecipitate-ternary carbonate. Thereafter, 1.5 wt % of $La(NO_3)_3.6H_2O$ and $Mg(NO_3)_2.6H_2O$, respectively, based on the total weight of the ternary carbonate were added to the solution containg the prepared coprecipitate-ternary carbonate. A coating of the mixture was then formed on the other side of the base metal.

The sleeve was inserted and fixed within an electron gun, and then a heater for heating the cathode was inserted and fixed within the sleeve. The electron gun was sealed in the bulb of an electron tube and then exhausted to create an internal vacuum. Thereafter, an electron tube was produced by a conventional manufacturing process and its initial emission was measured. The initial emission characteristic was measured using a quantity of current called "MIK" and the life span of the cathode was determined using the rate of residual buildup over a given period in relation to the initial MIK value.

EXAMPLE 2

A second ternary carbonate was obtained in the same manner as that of Example 1, except here, 1.4 wt % of lanthanum-magnesium nitrate $Mg_3La_2(NO_3)_{12}.24H_2O$ was added to the ternary carbonate instead of 1.5 wt % of $La(NO_3)_3.6H_2O$ and $Mg(NO_3)_2.6H_2O$. Afterwards, the initial emission characteristic and life span were measured in the same way as those of Example 1 (see FIG. 3).

EXAMPLE 3

A third ternary carbonate was obtained in the same manner as Example 2, except here, the base metal further contains 5 wt % of tungsten with respect to the nickel. Afterwards, the initial emission characteristic and life span were measured in the same way as those of Example 2 (see FIG. 3).

COMPARATIVE EXAMPLE

A conventional cathode was prepared in the same manner as Example 1 but without adding $La(NO_3)_3.6H_2O$ and $Mg(NO_3)_2.6H_2O$. Then, the initial emission characteristic and life span of the cathode was estimated (see FIG. 3).

Figure 3:
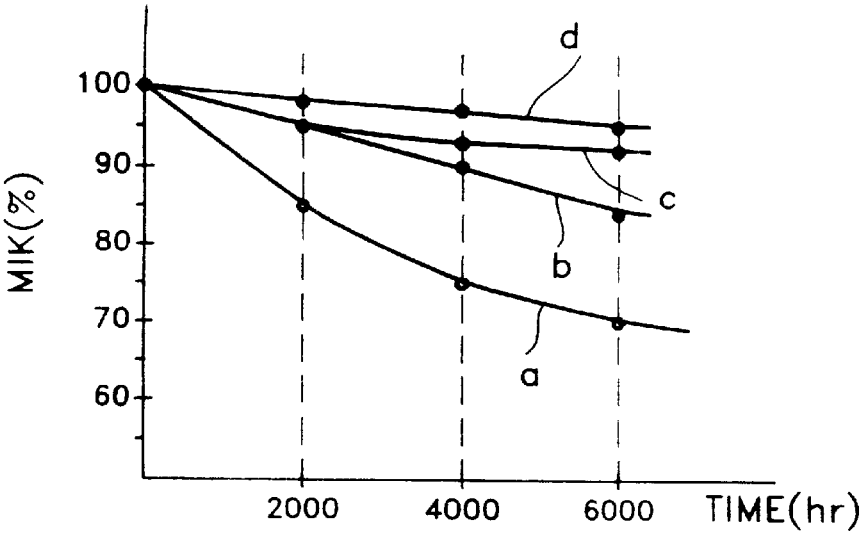
FIG. 3 is a graph comparing the life span characteristics of the cathode for an electron tube according to the present invention with that of a conventional cathode.

FIG. 3 illustrates life span characteristics of a conventional cathode and cathodes including the new material according to the embodiments of the present invention. Here, the "a" curve illustrates the life span characteristics of the conventional cathode whose layer of electron-emitting substance contains only a conventional ternary oxide, the "b" curve corresponds to a cathode whose layer further contains lanthanum and magnesium compounds besides the conventional ternary oxide, the "c" curve corresponds to a cathode whose layer further contains a lanthanum-magnesium composite compound besides the conventional ternary oxide, and the "d" curve corresponds to a cathode whose layer further contains a lanthanum-magnesium composite compound besides the conventional ternary oxide and whose base metal further contains tungsten. As indicated by FIG. 3, the life spans of the cathode according to the present invention was about 15–30% longer than that of the conventional cathode.

As shown in the examples and the comparative example, the cathode of the present invention, a new oxide cathode, not only has a life span about 15–30% longer than a conventional cathode under equal conditions, but is also capable of full interchangeability with the processes for manufacturing the conventional oxide cathode. Accordingly, a cathode according to the present invention overcomes the disadvantages of a short life span which hinders use in large-screen cathode ray tubes, while still being capable of incorporation into mass-production processes.

What is claimed is:

1. A cathode for an electron tube, said cathode comprising:

a base metal including nickel as a major component and tungsten as a minor component; and a layer of electron emitting substance disposed on said base metal and comprising an alkaline earth metal oxide including barium oxide as a major component and a lanthanum compound and a magnesium compound.

2. The cathode as claimed in claim 1, wherein said lanthanum compound and magnesium compound is a lanthanum-magnesium composite compound.

3. The cathode as claimed in claim 1, wherein the contents of said lanthanum compound and magnesium compound are 0.01–20 wt % based on the total weight of said alkaline earth metal oxide.

4. The cathode as claimed in claim 3, wherein the weight ratio of said lanthanum and said magnesium is 3:1 to 1:3.

5. The cathode as claimed in claim 1, wherein said tungsten is 0.05~10 wt % based on the weight of said nickel.

* * * * *